US009540881B2

(12) United States Patent
Guan et al.

(10) Patent No.: US 9,540,881 B2
(45) Date of Patent: Jan. 10, 2017

(54) METHOD AND SYSTEM FOR IMPROVING DRILLING SPEED BY USING DRILL SPEED VIBRATION

(75) Inventors: Zhichuan Guan, Qingdao (CN); Yongwang Liu, Qingdao (CN); Wenzhong Wei, Qingdao (CN); Ben Guan, Qingdao (CN); Yucai Shi, Qingdao (CN); Hongning Zhang, Qingdao (CN)

(73) Assignee: CHINA UNIVERSITY OF PETROLEUM (EAST CHINA) (CN)

( * ) Notice: Subject to any disclaimer, the term of this patent is extended or adjusted under 35 U.S.C. 154(b) by 536 days.

(21) Appl. No.: 13/882,982

(22) PCT Filed: Mar. 16, 2012

(86) PCT No.: PCT/CN2012/072450

§ 371 (c)(1),
(2), (4) Date: Feb. 25, 2014

(87) PCT Pub. No.: WO2012/142891

PCT Pub. Date: Oct. 26, 2012

(65) Prior Publication Data

US 2014/0166368 A1 Jun. 19, 2014

(30) Foreign Application Priority Data

Apr. 21, 2011 (CN) ..... 2011 1 0101056
Jun. 23, 2011 (CN) ..... 2011 1 0171384

(51) Int. Cl.
*E21B 7/18* (2006.01)
*E21B 17/04* (2006.01)
*E21B 21/06* (2006.01)
*E21B 10/18* (2006.01)

(52) U.S. Cl.
CPC ..... *E21B 7/18* (2013.01); *E21B 10/18* (2013.01); *E21B 17/04* (2013.01); *E21B 21/06* (2013.01)

(58) Field of Classification Search
CPC ..... E21B 7/18; E21B 17/04; E21B 10/18; E21B 21/06; E21B 10/60
See application file for complete search history.

(56) References Cited

U.S. PATENT DOCUMENTS 5,205,163 A * 4/1993 Sananikone ..... E21B 44/04 175/40
6,209,667 B1 * 4/2001 Murray ..... E21B 17/105 175/228
6,488,103 B1 * 12/2002 Dennis ..... E21B 4/003 175/106
2012/0175168 A1 * 7/2012 Lee ..... E21B 10/345 175/57
2013/0199849 A1 * 8/2013 Li ..... E21B 7/18 175/57

* cited by examiner

*Primary Examiner* — Yong-Suk (Philip) Ro
(74) *Attorney, Agent, or Firm* — Stoel Rives LLP

(57) ABSTRACT

A system for improving a drilling speed by using drill string vibration comprises a downhole drill string vibration-reduction and supercharging device, and an ultra-high pressure bit device used for a downhole supercharger. Also disclosed is a method for improving a drilling speed by using drill string vibration. Related embodiments are also disclosed.

13 Claims, 6 Drawing Sheets

METHOD AND SYSTEM FOR IMPROVING DRILLING SPEED BY USING DRILL SPEED VIBRATION

TECHNICAL FIELD

The present application relates to the field of oil and natural gas drilling engineering, in particular to the method and system for improving drilling speed by using drill string vibration.

BACKGROUND ART

As is well known, the main advantage of the method for increasing the injection pressure of the drilling fluid at the shaft bottom by installing specialized tools is that it can improves the drilling speed by ultra-high pressure jet which assists rock cracking directly or auxiliarily without changing the present drilling procedure or device requirements. The drilling engineers and technical inventors have been attempting to solve problems of how to improve the injection pressure of drilling fluid at the shaft bottom and how to realize the effective injection of the ultra-high pressure drilling fluid. In the existing methods of improving the injection pressure of the drilling fluid at the shaft bottom, the working power generally comes from the energy carried by the drilling fluid itself. The process of realization is to transfer the energy of most part of the drilling fluid into a small part of the drilling fluid by the specialized tools. The problems encountered during the realization and application process are as follows: i). the specialized tools designed according to such method have complicated structure and hence the working life and safety during the underground operation cannot be ensured; ii). as the well depth increases, the circulating pressure loss increases and the hydraulic pressure energy decreases, thus the effect of improving the drilling fluid injection pressure at the shaft bottom will be influenced; iii). a coupling phenomenon may be occurred due to the impact caused by the process of improving the injection pressure of drilling fluid at the shaft bottom and the inherent vibration of the drilling string, which influences the working life of the drilling bit and drilling tool; iv) during normal work, the specialized tools designed according to the method will generate a certain pressure drop, which will add the working load of the rotary system and may influence the normal function by the drilling fluid; v) since the drilling fluids all get involved in the energy transfer process, once the tool is disabled in the downhole, the circulation of the drilling fluid may be blocked and the construction cannot be carried out, even serious consequence will occur. The drilling bit used for realizing the injection of ultra-pressure drilling fluid at the shaft bottom is manufactured specifically. The problems encountered in use of such drilling bit are as follows: i). forming specialized runners for the ultra-high pressure drilling fluid into the drilling bit matrix will undoubtedly increase the cost of drilling task and thereby influence the spread application in different regions and stratums; ii). during the installation, it is possible that the runners can not be connected simultaneously; since the flow pipe of ultra-high pressure fluid does not have pressure-bearing and pull-bearing device, the fluid communication between ultra-high pressure runners may fails due to the excessive axial force or misalignment of the axis during the assemble and disassemble process with the tools for improving the injection pressure at the shaft bottom; iii). the connection process may make damage to the connection of ultra-high runner and of drilling bit body. During the connection process with the tools for improving the injection pressure of drilling fluid, the torque on the ultra-high pressure runner will act on the portion that connects the drilling bit body, which is likely to damage that portion. Therefore, despite of efforts and studies made by the researchers, the above method of improving the injection pressure of drilling fluid at the shaft bottom, and the method and apparatus of realizing effective injection of ultra-high pressure drilling fluid have not been spread in the field of improving the drilling speed yet.

SUMMARY OF THE INVENTION

The Technical Problem to be Solved

The technical problem to be solved by this invention is to provide a system and method of improving the injection pressure of drilling fluid at the shaft bottom by utilizing the drill string vibration so as to accelerate the drilling speed.

Technical Solution

In order to achieve the aforementioned objective, one aspect of the present application provides a system for improving a drilling speed by using drill string vibration comprising:

a downhole drill string vibration-reduction and supercharging device and an ultra-high pressure bit device used for a downhole supercharger. The downhole drill string vibration-reduction and supercharging device comprises a high-pressure runner. The ultra-high pressure bit device used for the downhole supercharger comprises an ultra-high pressure drilling fluid transmission runner. The ultra-high pressure drilling fluid transmission runner comprises an ultra-high pressure drilling fluid runner, a high-pressure resisting hose and a high-pressure resisting rigid tube. The high-pressure runner is connected to the ultra-high pressure drilling fluid runner; one end of the high-pressure resisting hose is connected to the ultra-high pressure drilling fluid runner, and the other end of the high-pressure resisting hose is connected to the high-pressure resisting rigid tube; and the other end of the high-pressure resisting rigid tube is connected to an ultra-high pressure drilling fluid nozzle.

Further, the downhole drill string vibration-reduction and supercharging device further comprises: an upper transition joint, a spring, an upper plugging joint of the spring, a spring outer case, a lower plugging joint of the spring, a central shaft, a splined outer sleeve, a piston shaft, a locking nut, an inlet one-way valve, a sealing assembly, a supercharging cylinder, a supercharging cylinder righting sleeve, a supercharging cylinder outer sleeve, an outlet one-way valve, and a lower transition joint; the upper transition joint, the upper plugging joint of the spring, the central shaft, the piston shaft and the inlet one-way valve are joined together into an integral; the central shaft engages with the splined outer sleeve so as to transmit the torque and to allow the central shaft to move up and down; the central shaft connects with the piston shaft via threads and gets locked by the locking nut; the spring outer case, the lower plugging joint of the spring, the splined outer sleeve, the supercharging cylinder outer sleeve and the lower transition joint are jointed together into an integral; the spring are positioned within the spring outer case; the supercharging cylinder are fixed within the supercharging cylinder righting sleeve; the supercharging cylinder righting sleeve are positioned within the supercharging cylinder outer sleeve; a sealing assembly is positioned at the side where the supercharging cylinder contacts with the piston shaft; an outlet one-way valve connecting a high-pressure runner is positioned at the other side of the supercharging cylinder.

Further, the ultra-high pressure bit device used for a downhole supercharger further comprises: a common drilling fluid transmission channel, which is a communication runner composed by a flow hole of righting flow structure, an annular space between the ultra-high pressure drilling fluid runner and an inner hole of transition joint, a flow hole of split centralizer, and an annular space between the ultra-high pressure drilling fluid runner and a lumen within the bit body.

Further, a drilling fluid runner opening into a nozzle is positioned within the bit body, a high-pressure resisting rigid tube is positioned within one of the drilling fluid runners, the high-pressure resisting rigid tube is provided at its outside with a rigid tube stop collar, and then installed with an ultra-high pressure drilling fluid nozzle; the external end of the bit body connects the box of the transition joint; an righting flow structure is positioned in the inner hole of the pin end of the transition joint, engaging with a small-hole limiting nut and a large-hole limiting nut, for bearing the axial tension and pressure created by the sealing assembly which acted on the ultra-high pressure drilling fluid runner when the downhole vibration-reduction and supercharging device assembles and disassembles with the system; a hexahedron is assembled into a hexagonal inner hole of the righting flow structure; a gap exists between the hexahedron and the ultra-high pressure drilling fluid runner.

Further, the small-hole limiting nut is mounted on the ultra-high pressure drilling fluid runner, the lower surface of which contacts with the upper surface of the righting flow structure for bearing the axial pressure created by the sealing assembly which acted on the ultra-high pressure drilling fluid runner when the downhole supercharging device connects with the system.

Further, the big-hole limiting nut is mounted on the ultra-high pressure drilling fluid runner, the upper surface of which contacts with the lower surface of the righting flow structure for bearing the axial tension created by the sealing assembly which acted on the ultra-high pressure drilling fluid runner when the downhole supercharging device disassembles with the system.

Further, a split centralizer is positioned at the connection of the transition joint and the bit body for realizing the centering of the ultra-high pressure drilling fluid runner and flowing of the common pressure drilling fluid.

Further, the ultra-high pressure drilling fluid nozzle is mounted on the bit body by the thread to realize the injection of the ultra-high pressure drilling fluid; a sealing O-ring is arranged between the inner surface of the ultra-high pressure drilling fluid nozzle and the outer surface of the high-pressure resisting rigid tube to achieve sealing.

Further, the bit body may be a roller bit or a PDC bit of various types.

In another aspect, the present application further provides a method for improving a drilling speed by using drill string vibration comprising:

The realization process is to improve the injection pressure of drilling fluid by the method of improving injection pressure of the drilling fluid at the shaft bottom by using drill string vibration, and to realize effective injection by utilizing the ultra-high pressure bit runner system for downhole supercharger, and to crack rock directly or auxiliarily so as to accelerate the drilling speed. The method of improving the injection pressure of drilling fluid at the shaft bottom by using the drill string vibration is the core of the method of improving the drilling speed by using drill string vibration. The method comprises: the power source adopted is the power provided by the bit pressure fluctuation generated in the bit body; the drilling fluid enters into the lumen in the downhole drill string vibration-reduction and supercharging device; after being shunt by the shunt mechanism, most part of the drilling fluid is injected via the ordinary pressure nozzle; other small part of drilling fluid enters into the power conversion unit via the inlet one-way valve in the downhole drill string vibration-reduction and supercharging device; after obtaining the power source and the high energy coming from reducing the fluctuation amplitude of bit pressure, the drilling fluid is discharged via the outlet one-way valve which is connecting to the ultra-high pressure runner and finally injected by the ultra-high pressure jet nozzle to to realize the ultra-high pressure jet which facilitates rock cracking directly or auxiliarily.

Further, the power conversion unit comprises: a power conversion cavity, a transmission lever of bit pressure, springs, a drill string body and a lubricant cavity; the increasing of the inject pressure of drilling fluid is completed in the power conversion cavity; when the bit pressure on the drill string body is increased, the transmission lever of bit pressure compresses the spring and the drilling fluid in the power conversion cavity; the pressure increase of the drilling fluid in the power conversion cavity enables the close of the inlet one-way valve and the open of the outlet one-way valve; the drilling fluid that absorbs the power source energy is discharged via the outlet one-way valve and is ejected via the ultra-high drilling fluid nozzle to realize the ultra-high pressure jet which facilitates rock cracking directly or auxiliarily.

Further, the spring withstands the pressure of the transmission lever of bit pressure, generating compression force and storing energy; at this time the lubricant on the spring is compressed into the lubricant cavity; when the bit pressure on the drill string body reduces, the flexible element withstanding the pressure of the transmission lever of bit pressure and generating elastic potential energy, stretches and releases energy to decrease the pressure in the power conversion cavity; the inlet one-way valve of the power conversion unit is opened and the outlet one-way valve of the power conversion unit is closed; the drilling fluid flows into the power conversion cavity, meanwhile the lubricant in the lubricants cavity flows back to the flexible element to lubricate and cool the flexible element.

Further, the two flows of drilling fluid shunt by the shunting structure flow into the shaft bottom along two separate runners without interfering with each other; when the power conversion unit is disabled, the drilling fluid can directly enter into the ordinary pressure nozzle via the shunt mechanism and be injected out by the ordinary pressure nozzle.

Advantageous Effect

The present application provides a system and a method for improving a drilling speed by using drill string vibration. The system structure is stable and reliable. The core of the method lies in that, the power source in the method of improving injection pressure of the drilling fluid at the shaft bottom is the bit pressure fluctuation at the shaft bottom during drilling, and the injection pressure of the drilling fluid at the shaft bottom is improved by using energy obtained from the decrease of the bit pressure fluctuation. The adverse effect of the bit pressure fluctuation on the drilling procedure is reduced, which ensures construction safety and improves injection pressure of the drilling fluid at the shaft bottom.

DESCRIPTION OF EMBODIMENTS

Figure 1:
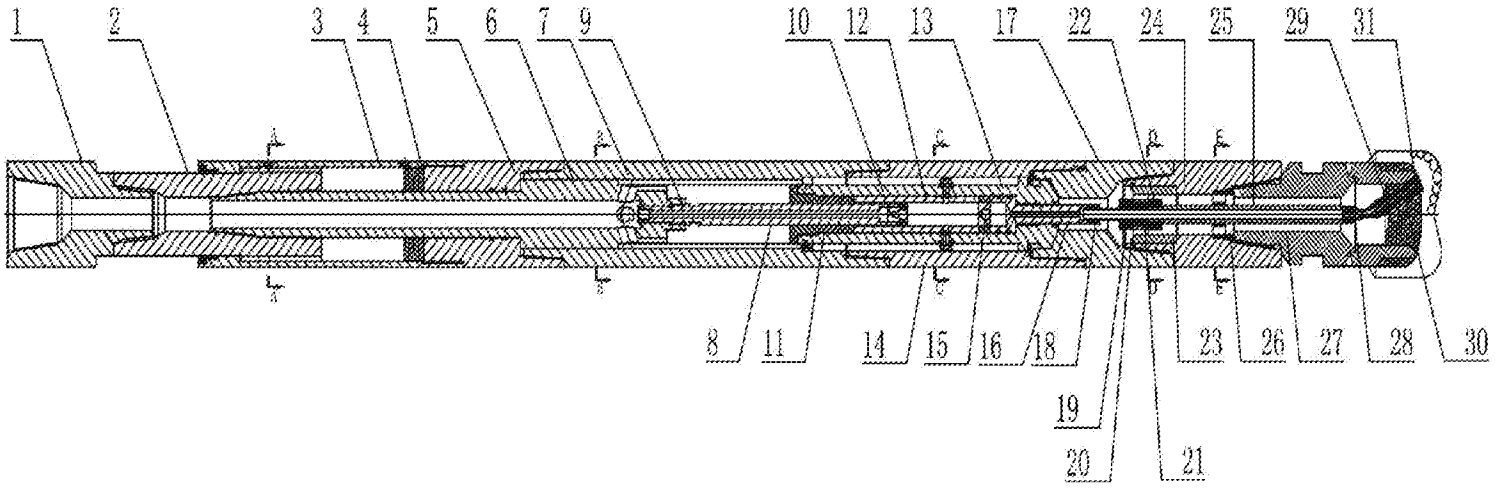
FIG. 1 is a schematic view of the system structure to improve the drilling speed by using drill string vibration according to the present application.
Figure 2:
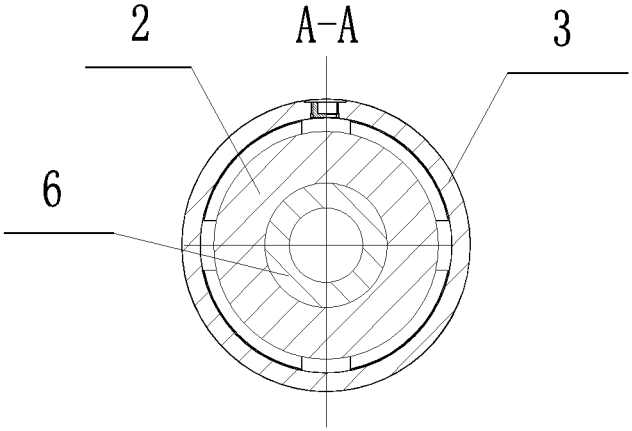
FIG. 2 is a cut-away view taken along line A-A of FIG. 1.
Figure 3:
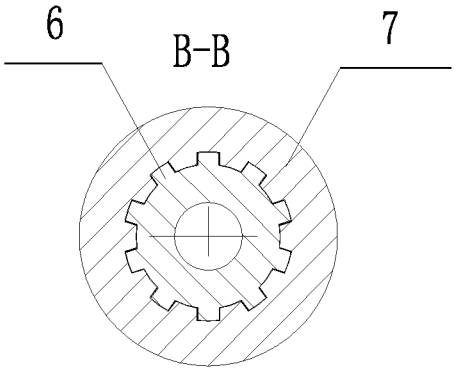
FIG. 3 is a cut-away view taken along line B-B of FIG. 1.
Figure 4:
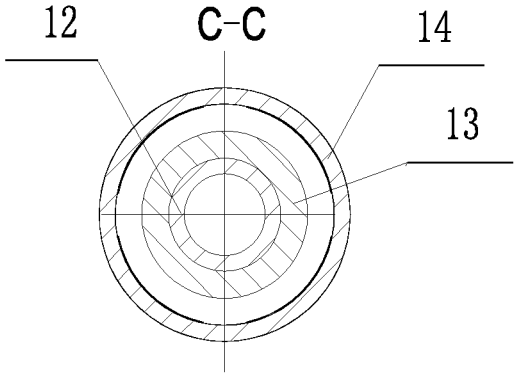
FIG. 4 is a cut-away view taken along line C-C of FIG. 1.
Figure 5:
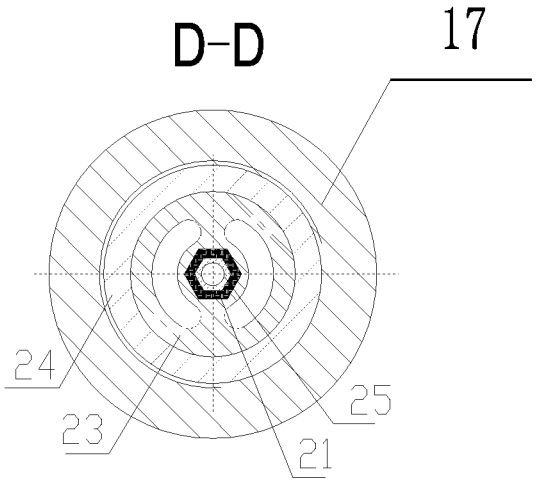
FIG. 5 is a cut-away view taken along line D-D of FIG. 1.
Figure 6:
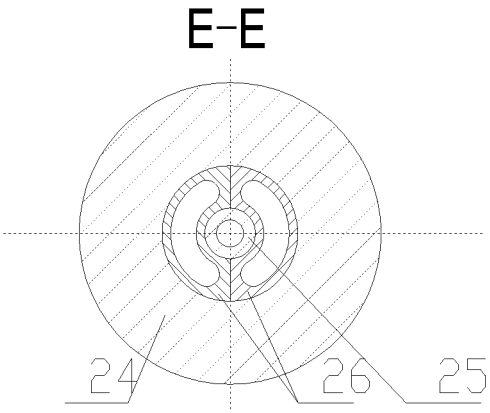
FIG. 6 is a cut-away view taken along line E-E of FIG. 1.

Specific embodiments of the present invention are described in details below with reference to the accompanying drawings. These embodiments are presented herein for description purpose only but not for limiting the scope of the present application.

As shown in FIG. 1-6, the system for improving drilling speed by using drill string vibration herein specifically comprises: a downhole drill string vibration-reduction and supercharging device and an ultra-high pressure bit device used for a downhole supercharger. The downhole drill string vibration-reduction and supercharging device comprises a high-pressure runner 16. The ultra-high pressure bit device used for the downhole supercharger comprises an ultra-high pressure drilling fluid transmission runner. The ultra-high pressure drilling fluid transmission runner comprises an ultra-high pressure drilling fluid runner 25, a high-pressure resisting hose 28 and a high-pressure resisting rigid tube 30. The high-pressure runner 16 is connected to the ultra-high pressure drilling fluid runner 25; one end of the high-pressure resisting hose 28 is connected to the ultra-high pressure drilling fluid runner, and the other end of the high-pressure resisting hose 28 is connected to the high-pressure resisting rigid tube; and the other end of the high-pressure resisting rigid tube is connected to an ultra-high pressure drilling fluid nozzle 31.

Figure 7:
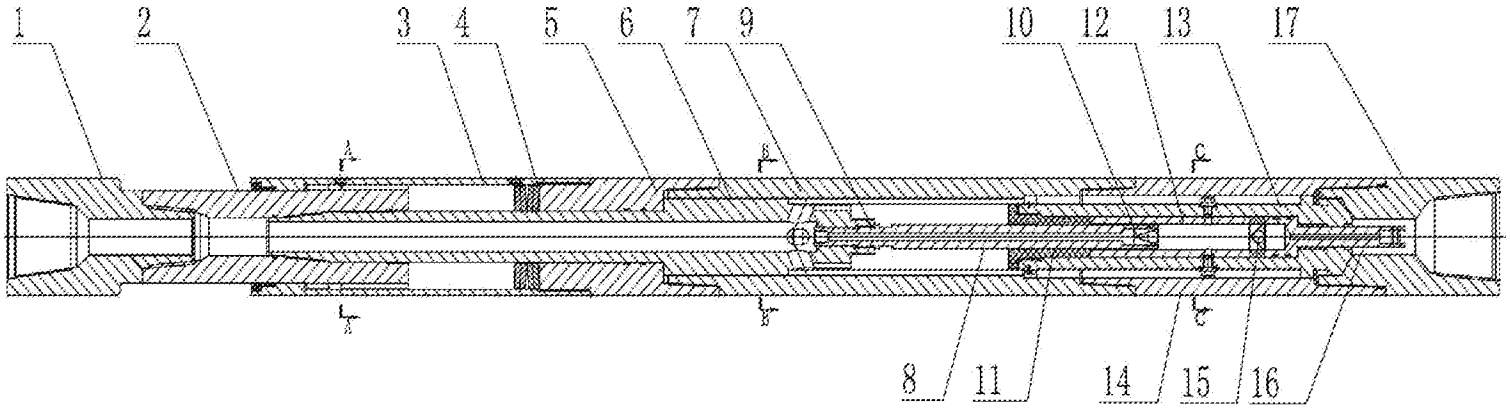
FIG. 7 is a structural schematic view of the downhole drill string vibration-reduction and supercharging device in the system for improving a drilling speed by using drill string vibration according to the present application.

Referring to FIG. 7, the downhole drill string vibration-reduction and supercharging device further comprises: an upper transition joint 1, an upper plugging joint 2 of the spring, a spring outer case 3, a spring 4, a lower plugging joint 5 of the spring, a central shaft 6, a splined outer sleeve 7, a piston shaft 8, a locking nut 9, an inlet one-way valve 10, a sealing assembly 11, a supercharging cylinder 12, a supercharging cylinder righting cylinder 13, a supercharging cylinder outer sleeve 14, an outlet one-way valve 15, a lower transition joint 17; the upper transition joint 1, the upper plugging joint 2 of the spring, the central shaft 6, the piston shaft 8 and the inlet one-way valve 10 are jointed together into an integral; the central shaft 6 engages with the splined outer sleeve 7 to transmit the torque and to allow the central shaft 6 to move up and down; the central shaft 6 connects with the piston shaft 8 via threads and gets locked by the locking nut 9; the spring outer case 3, the lower plugging joint 5 of the spring, the splined outer sleeve 7, the supercharging cylinder outer sleeve 14 and the lower transition joint 17 are jointed together into an integral; the spring 4 are positioned within the spring outer case 3; the supercharging cylinder 12 is fixed within the supercharging cylinder righting sleeve 13; the supercharging cylinder righting sleeve 13 is positioned within the supercharging cylinder outer sleeve 14; a sealing assembly 11 is positioned at one side where the supercharging cylinder 12 contacts with the piston shaft 8; an outlet one-way valve 15 connecting a high-pressure runner 16 is positioned at the other side of the supercharging cylinder 12.

The upper portion of the device is a vibration-reduction system, and the lower portion is a supercharging system of drilling fluid. The device can be integrally connected between the drill string and the bit for cracking rock. During drilling, the drill string sets the upper transition joint 1, the upper plugging joint 2 of the spring, the central shaft 6, and the piston shaft 8 in up-and-down motion together due to the longitudinal vibration of the drill string; meanwhile, the spring 4 in the spring outer case 3 ensures that the spring outer case, the supercharging cylinder 12 etc. will not move up-and-down along with the drill string by compression and expansion. When the drill string moves upwards, it drives the central shaft 6 and the piston shaft 8 to move upwards relative to the supercharging cylinder 12, and negative pressure is generated in the supercharging cylinder 12, thus the drilling fluid is sucked therein. When the drill string moves downwards, it drives the central shaft 6 and the piston shaft 8 to move downwards, and the drilling fluid in the supercharging cylinder 12 is compressed and pressurized. The pressurized drilling fluid enters into the ultra-high pressure drilling fluid runner via the outlet one-way valve 15. The ultra-high pressure drilling fluid runner is connected to the ultra-high pressure hose in the ultra-high pressure bit device used for a downhole supercharger so as to generate high pressure jet to assist for breaking rock at the shaft bottom.

Figure 8:
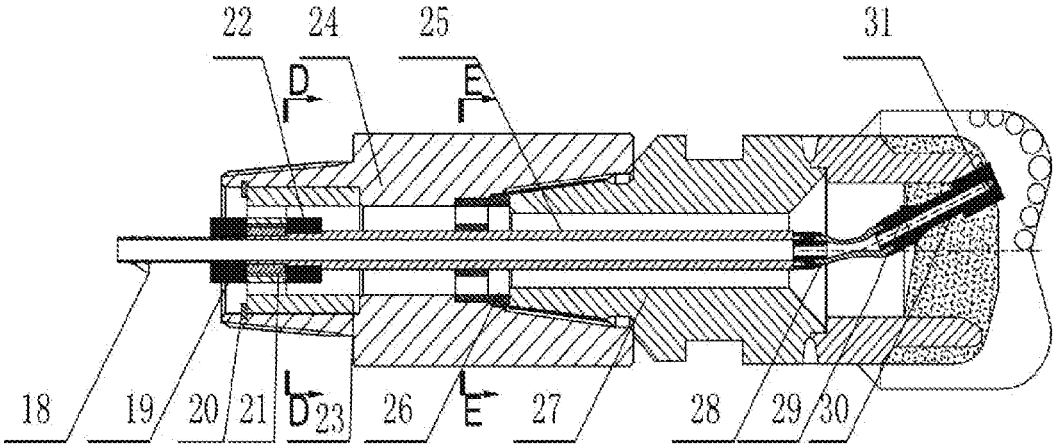
FIG. 8 is a schematic view of the ultra-high pressure bit device used for a downhole supercharger in the system for improving a drilling speed by using drill string vibration according to the present application.
Figure 9:
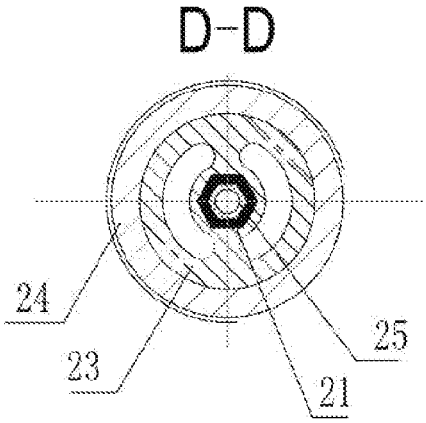
FIG. 9 is a cut-away view taken along line D-D of FIG. 8.
Figure 10:
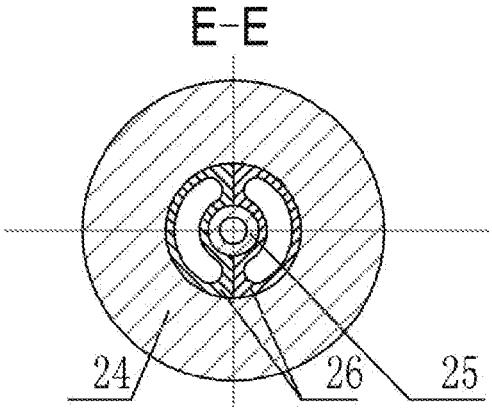
FIG. 10 is a cut-away view taken along line E-E of FIG. 8.

Referring to FIG. 8-10, the ultra-high pressure bit device used for a downhole supercharger comprises ultra-high pressure drilling fluid transmission channel and common drilling fluid transmission channel. The ultra-high pressure drilling fluid transmission channel is an integral assembled by the ultra-high pressure drilling fluid runner 25, the high-pressure resisting hose 28, the high-pressure resisting rigid tube 30 and the ultra-high pressure drilling fluid nozzle 31 through connection; The common drilling fluid transmission channel is a communication runner composed by an flow hole of righting flow structure 23, an annular space between the ultra-high pressure drilling fluid runner 25 and an inner hole of transition joint 24, an flow hole of split centralizer 26, and an annular space between the ultra-high pressure drilling fluid runner 25 and a lumen within a bit body 27.

The working principle of this invention is as follows. The ultra-high pressure drilling fluid runner 25, the high-pressure resisting hose 28, the high-pressure resisting rigid tube 30 and the ultra-high pressure drilling fluid nozzle 31 are assembled into an integral through connection, which is used to transmit the ultra-high pressure drilling fluid generated by the downhole vibration-reduction and supercharging device to the shaft bottom and injecting this ultra-high pressure drilling fluid, and hence to realize the ultra-high pressure jet which facilitates rock cracking directly or auxiliarily; The communication runner composed by an flow hole of righting flow structure 23, an annular space between the ultra-high pressure drilling fluid runner 25 and an inner hole of transition joint 24, an flow hole of split centralizer 26, and an annular space between the ultra-high pressure drilling fluid runner 25 and a lumen within a bit body 27, is used for the transmission of common drilling fluid. The common pressure drilling fluid that reaches the bit body 27 is injected out via the common nozzle on the bit body to realize the normal function of drilling fluid.

A drilling fluid runner opening into a nozzle is positioned within the aforementioned bit body 27, a high-pressure resisting rigid tube 30 is positioned within one of the drilling fluid runners, the high-pressure resisting rigid tube 30 is at its outside provided with a rigid tube stop collar 29 and then installed with an ultra-high pressure drilling fluid nozzle 31; the external end of the bit body 27 connects the box of the transition joint 24; an righting flow structure is positioned in the inner hole of the pin end of the transition joint 24, engaging with small-hole limiting nut 19 and large-hole limiting nut 22, for bearing the axial tension and pressure created by the sealing assembly and acted on the ultra-high pressure drilling fluid runner 25 when the downhole vibration-reduction and supercharging device assembles and disassembles with the system; a hexahedron 21 is assembled into a hexagonal inner hole of the righting flow structure 23; a gap exists between the hexahedron 21 and the ultra-high pressure drilling fluid runner 25.

The righting flow structure 23 is installed in the inner hole of the pin end of the transition joint 24 via left-hand thread, engaging with the small-hole limiting nut 19 and the large-hole limiting nut 22, for bearing the axial tension and pressure created by the sealing assembly which acted on the ultra-high pressure drilling fluid runner 25 when the downhole vibration-reduction and supercharging device assembles and disassembles with the device.

The small-hole limiting nut 19 is mounted on the ultra-high pressure drilling fluid runner 25, the lower surface of which contacts with the upper surface of the righting flow structure 23, for bearing the axial pressure created by the sealing assembly which acted on the ultra-high pressure drilling fluid runner 25 when the downhole supercharging device assembles with the device.

The big-hole limiting nut 22 is mounted on the ultra-high pressure drilling fluid runner 25, the upper surface of which contacts with the lower surface of the righting flow structure 23, for bearing the axial tension created by the sealing assembly which acted on the ultra-high pressure drilling fluid runner 25 when the downhole supercharging device disassembles with the device.

The hexahedron 21 is mounted in the space between the hexagonal inner hole of the righting flow structure 23 and the ultra-high pressure drilling fluid runner 25, for bearing the circumference torque generated by the sealing assembly which acted on the ultra-high pressure drilling fluid runner 25 when the downhole supercharging device assembles and disassembles with the system.

The limiting stop collar 20 is mounted in the upper part of the righting flow structure 23 for fixing the righting flow structure 23 so as to enable it bearing the torque without rotating.

There are spaces of 0.5 mm between the hexahedron 21 and the hexagonal inner hole of the righting flow structure 23, and between the hexahedron 21 and the hexagonal section of the ultra-high pressure drilling fluid runner 25 respectively. This provides space for centering the downhole supercharging device and the axis of ultra-high pressure drilling fluid runner of the system.

A split centralizer 26 is positioned at the connection of the transition joint 24 and the bit body 27 for realizing the centering of the ultra-high pressure drilling fluid runner 25 and the flowing of the common pressure drilling fluid.

A rigid tube stop collar 29 is mounted at the neck of the high-pressure resisting rigid tube 30 to fasten the high-pressure resisting rigid tube 30.

The ultra-high pressure drilling fluid nozzle 31 is mounted on the bit body 27 by the threads to realize the injection of the ultra-high pressure drilling fluid. A sealing O-ring is mounted between the inner surface of the ultra-high pressure drilling fluid nozzle 31 and the outer surface of the high-pressure resisting rigid tube 30 to achieve sealing.

The righting flow structure 23 and the flow hole of split centralizer 26 are not limited to the structures illustrated in the drawings, for example, they may be circular holes etc.

In addition, the bit body 27 for constructing the system of the present application may be a roller bit or a PDC bit etc., the dimensions and shapes are not limited to those illustrated in the figures.

Wherein, the construction method of the ultra-high pressure bit device used for a downhole supercharger comprises:

1. connecting the ultra-high pressure drilling fluid runner 25, the high-pressure resisting hose 28 and the high-pressure resisting rigid tube 30 into an integral; positioning the large-hole limiting nut 22 on the ultra-high pressure drilling fluid runner 25;
2. disposing the high-pressure resisting rigid tube 30 of the assembly in the step 1 into the drilling fluid runner of the bit body 27; arranging a rigid tube stop collar 29 over the high-pressure resisting rigid tube 30, and then installing the ultra-high pressure drilling fluid nozzle 31.
3. setting the righting flow structure 23 at the pin of the transition joint 24, and installing the limiting stop collar 3 to prevent from the movement of the righting flow structure 23.
4. holding the split centralizer 26 tightly on the ultra-high pressure drilling fluid runner 25 and installing the transition joint 24; ensuring the upper portion of the ultra-high pressure drilling fluid runner 25 to pass through the hole in the righting flow structure 23 during installation.
5. installing the hexahedron 21 in the space between the hexagonal inner hole of the righting flow structure 23 and the ultra-high pressure drilling fluid runner 25.
6. screwing the small-hole limiting nut 19 onto the ultra-high pressure drilling fluid runner 25.

On the other hand, the present application provides a method for improving a drilling speed by using drill string vibration comprising: a method for improving the injection pressure of the drilling fluid at the shaft bottom by using drill string vibration and a construction method for the runner system of the ultra-high pressure bit device used for a downhole supercharger. The method for improving the injection pressure of the drilling fluid at the shaft bottom by using drill string vibration comprises: the power source adopted is the power generated by the bit pressure fluctuation in the bit body; the drilling fluid enters into the cavity in the downhole drill string vibration-reduction and supercharging device; after being shunt by the shunt mechanism, most part of the drilling fluid is injected via the ordinary pressure nozzle, in this device, the shunt mechanism is a bottom shunt hole of the central shaft; other small part of the drilling fluid enters into the power conversion unit via the inlet one-way valve in the downhole drill string vibration-reduction and supercharging device; after obtaining the power source and the high energy coming from reducing the fluctuation amplitude of bit pressure, the drilling fluid is discharged via the outlet one-way valve connecting the high-pressure runner and finally is injected by the ultra-high pressure drilling fluid nozzle, to realize the ultra-high pressure jet which facilitates rock cracking directly or auxiliarily. The power conversion unit is composed by the sealing assembly, the supercharging cylinder and the supercharging cylinder righting sleeve. The power conversion unit comprises: a power conversion cavity, a transmission lever of bit pressure, springs, the drill string body and the lubricant cavity; the power conversion cavity is composed by the sealing assembly, the supercharging cylinder and the supercharging cylinder righting sleeve; the transmission lever of bit pressure is composed of the upper transition joint, the upper plugging joint of the spring, the central shaft, the piston shaft, the locking nut and the inlet one-way valve; the lubricant cavity is composed by the lower plugging joint of the spring, the spring outer case, the lower plugging joint of the spring, and the central shaft.

The increasing of the inject pressure of drilling fluid is completed in the power conversion cavity; when the bit pressure on the bit body is increased, the transmission lever of bit pressure compresses the spring and the drilling fluid in the power conversion cavity; the pressure increase of the drilling fluid in the power conversion cavity enables the close of the inlet one-way valve and the open of the outlet one-way valve; the drilling fluid that absorbs the power source energy is discharged out via the outlet one-way valve and is ejected via the ultra-high drilling fluid nozzle to realize the ultra-high pressure jet which facilitates rock cracking directly or auxiliarily. The spring withstands the pressure of transmission lever of bit pressure, and generates compression force and stores energy; meanwhile the lubricant on the spring is compressed into the lubricant cavity; when the bit pressure on the drill string body reduces, the flexible element withstanding the pressure of the transmission lever of bit pressure and generating elastic potential energy, stretches and releases energy to decrease the pressure in the power conversion cavity; open the inlet one-way valve of the power conversion unit and close the outlet one-way valve of the power conversion unit; drilling fluid flows into the power conversion cavity, meanwhile the lubricant in the lubricant cavity flows back to the flexible element to lubricate and cool the flexible element. The two flows of the drilling fluid shunt by the shunting structure flow into the shaft bottom along two separate runners respectively, without interfering with each other; when the power conversion unit is disabled, the drilling fluid can enter into the ordinary pressure nozzle via the shunt mechanism and be injected out by the ordinary pressure nozzle. Therefore, the normal drilling construction will proceed normally and the risk of the drilling operation will not be raised.

Figure 11:
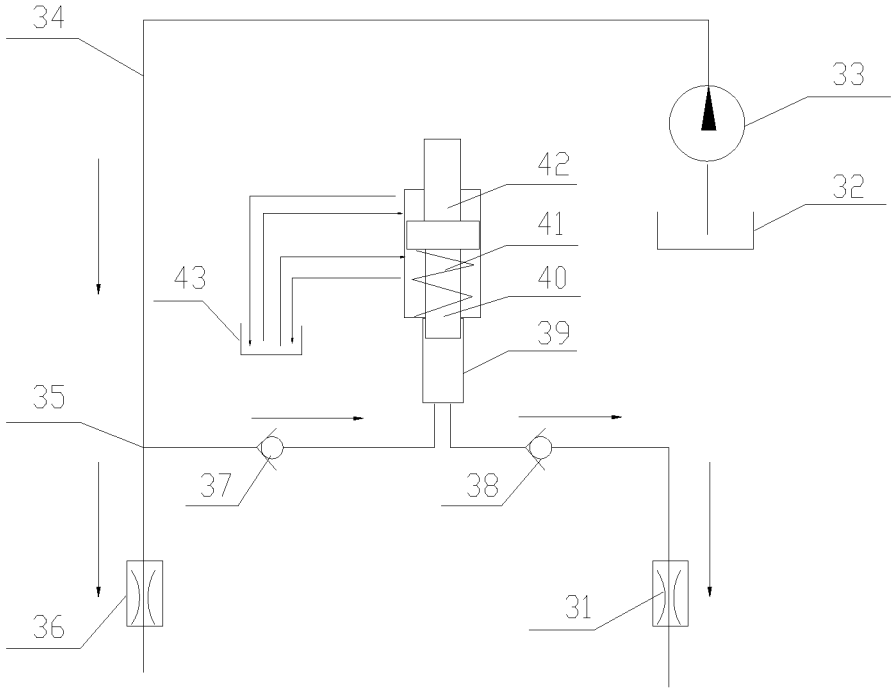
FIG. 11 is a flow-chart schematic view of the method for improving the injection pressure of drilling fluid at the shaft bottom by using the bit pressure fluctuation according to the present application.

Referring to FIG. 11, the specific implementation processes of the aforementioned method are as follows: in the mud pit 32, the drilling fluid is powered by the mud pump 33 and then enters into the cavity 34 of the drill string. After being shunt by the shunt mechanism 35, most part of the drilling fluid is injected by the common pressure nozzle 36 to function as conventional drilling fluid. The circulation of that portion of drilling fluid is not interfered by the process of improving injection pressure of other part of the drilling fluid. Other small part of the drilling fluid enters into the power conversion unit via the inlet one-way valve 37, after obtaining the power source—the energy acquired by reducing the fluctuation amplitude of bit pressure reaches the pressure of 80-100 Mpa or higher, the drilling fluid is discharged via the outlet unilateral valve 38, and is finally injected by the ultra-high pressure drilling fluid nozzle to realize the ultra-high pressure jet which facilitates rock cracking directly or auxiliarily. The increasing of the inject pressure of drilling fluid is completed in the power conversion cavity 39; when the bit pressure on the bit body 42 is increased, the transmission lever 40 of bit pressure compresses the drilling fluid in the power conversion cavity and the flexible element 41; the pressure increase of the drilling fluid in the power conversion cavity 39 enables the close of the inlet one-way valve 37 and the open of the outlet one-way valve 38; the drilling fluid that absorbs the power source energy is discharged via the outlet one-way valve 38 and ejected via the ultra-high drilling fluid nozzle to realize the ultra-high pressure jet which facilitates rock cracking directly or auxiliarily. The spring withstands the pressure of transmission lever of bit pressure, and generates compression and stores energy, meanwhile the lubricant on the spring is compressed into the lubricant cavity; when the bit pressure on the drill string body reduces, the spring withstanding the pressure of the transmission lever of bit pressure and generating elastic potential energy, stretches and releases energy to decrease the pressure in the power conversion cavity; open the inlet one-way valve and close the outlet one-way valve; drilling fluid flows into the power conversion cavity 39, meanwhile the lubricant in the lubricant cavity 43 flows back to the flexible element to lubricate and cool the flexible element.

The method of improving the injection pressure of drilling fluid at the shaft bottom by using the drill string vibration is a brand new one. The corresponding structure of the device is simple and the system is stable and reliable. The construction method of the ultra-high pressure drilling bit runner system used for the downhole supercharger is easy to implement and saves operating time. It is able to construct various of ultra-high pressure bit device. On the spot, the downhole drill string vibration-reduction and supercharging device designed by the method of improving the injection pressure of the drilling fluid at the shaft bottom by using the drill string vibration engages with the bit constructed by the construction method of using the ultra-high pressure bit runner system to improve the drilling speed. The drilling rate for the deep hard formation is improved by 1-5 times than the conventional drilling method. The fierce fluctuation of the bit pressure observed at the drill floor has been greatly improved. Practice proves that the method and system of improving the drilling speed by using the drill string vibration both improve the drilling speed and effectively reduce the vibration of the drill string at the shaft bottom. r

INDUSTRIAL APPLICABILITY

The present invention provides a system and method of improving the drilling speed by using the drill string vibration comprising a system and method of improving the injection pressure of the drilling fluid at the shaft bottom by using the drilling string vibration, and a system and method realizing the ultra-high drilling fluid injection at the shaft bottom. Also provided is a method and system of improving the injection pressure of the drilling fluid at the shaft bottom by using the fluctuation of bit pressure. That system is stable and reliable. The power source in this method of improving the injection pressure of the drilling fluid at the shaft bottom is the fluctuation of bit pressure at the shaft bottom during drilling. The energy obtained by reducing the fluctuation amplitude is utilized to improve the injection pressure of drilling fluid at the shaft bottom. The adverse effect of the bit pressure fluctuation on the drilling procedure is reduced, which ensures construction safety and improves injection pressure of the drilling fluid at the shaft bottom. A system and method of realizing the injection of ultra-high pressure drilling fluid at the shaft bottom, namely an ultra-high pressure bit device used for a downhole supercharger and the construction method of the ultra-high pressure bit runner used for a downhole supercharger, only require the construction of other assembly in the system exclusive of the bit body according to the construction method of the system and hence realize the conversion from the common bit to ultra-high pressure double-runner bit. This facilitates the widespread of the downhole supercharging device.

What is claimed is:

1. A system for improving a drilling speed by using drill string vibration, the system comprising: a downhole drill string vibration-reduction and supercharging device, and an ultra-high pressure bit device used for a downhole supercharger; said downhole drill string vibration-reduction and supercharging device comprises a high-pressure runner; said ultra-high pressure bit device used for the downhole supercharger comprises an ultra-high pressure drilling fluid transmission runner; said ultra-high pressure drilling fluid transmission runner comprises an ultra-high pressure drilling fluid runner, a high-pressure resisting hose and a high-pressure resisting rigid tube; said high-pressure runner is connected to the ultra-high pressure drilling fluid runner; one end of said high-pressure resisting hose is connected to the ultra-high pressure drilling fluid runner, and the other end of said high-pressure resisting hose is connected to the high-pressure resisting rigid tube; and said high-pressure resisting rigid tube is connected to an ultra-high pressure drilling fluid nozzle.

2. The system according to claim 1 characterized in that, the downhole drill string vibration-reduction and supercharging device further comprises: an upper transition joint, a spring, an upper plugging joint of the spring, a spring outer case, a lower plugging joint of the spring, a central shaft, a splined outer sleeve, a piston shaft, a locking nut, an one-way inlet valve, a sealing assembly, a supercharging cylinder, a supercharging cylinder righting sleeve, a supercharging cylinder outer sleeve, a one-way outlet valve, and a lower transition joint;

wherein the upper transition joint, the spring, the upper plugging joint of the spring, the central shaft, the piston shaft, and the one-way inlet valve are integrally joined together;

wherein the central shaft engages with the splined outer sleeve to transmit torque and allow the central shaft to move up and down;

wherein the central shaft connects with the piston shaft via thread and gets locked by the locking nut;

wherein the spring outer case, the lower plugging joint of the spring, the splined outer sleeve, the supercharging cylinder outer sleeve, and the lower transition joint are integrally joined together;

wherein the spring is positioned within the spring outer case;

wherein the supercharging cylinder is fixed within the supercharging cylinder righting sleeve;

wherein the supercharging cylinder righting sleeve is positioned within the supercharging cylinder outer sleeve;

wherein the sealing assembly is positioned at a first side where the supercharging cylinder contacts with the piston shaft; and wherein the one-way outlet valve connecting a high-pressure runner is positioned at a second side of the supercharging cylinder.

3. The system according to claim 1 characterized in that, said ultra-high pressure bit device used for a downhole supercharger further comprises a common drilling fluid transmission channel, which is a communication runner composed by a flow hole of righting flow structure, an annular space between the ultra-high pressure drilling fluid runner and an inner hole of a transition joint, a flow hole of split centralizer, and an annular space between the ultra-high pressure drilling fluid runner and a lumen within a bit body.

4. The system according to claim 3 characterized in that, a drilling fluid runner opening into a nozzle is positioned within said bit body, a high-pressure resisting rigid tube is positioned within one of the drilling fluid runners, an outside of the high pressure resisting rigid tube is provided with a rigid tube stop collar and then installed with an ultra-high pressure drilling fluid nozzle; the external end of said bit body connects the box of the transition joint; a righting flow structure is positioned in the inner hole of the pin end of the transition joint, engaging with a small-hole limiting nut and a large-hole limiting nut, for bearing the axial tension and pressure created by the sealing assembly; a hexahedron is assembled into a hexagonal inner hole of the righting flow structure; a gap exists between the hexahedron and the ultra-high pressure drilling fluid runner.

5. The system according to claim 4 characterized in that, the small-hole limiting nut is mounted on the ultra-high pressure drilling fluid runner, the lower surface of which contacts with the upper surface of the righting flow structure, for bearing the axial pressure created by the sealing assembly.

6. The system according to claim 4 characterized in that, the large-hole limiting nut is mounted on the ultra-high pressure drilling fluid runner, the upper surface of which contacts with the lower surface of the righting flow structure, for bearing the axial tension created by the sealing assembly.

7. The system according to claim 4 characterized in that, a split centralizer is positioned at the connection of the transition joint and the bit body for realizing the centering of the ultra-high pressure drilling fluid runner and flowing of the common pressure drilling fluid.

8. The system according to claim 3 characterized in that, the ultra-high pressure drilling fluid nozzle is mounted on the bit body by thread to realize the injection of the ultra-high pressure drilling fluid; a sealing O-ring is mounted between the inner surface of the ultra-high pressure drilling fluid nozzle and the outer surface of the high-pressure resisting rigid tube to achieve sealing.

9. The system according to claim 3 characterized in that, the bit body is a roller bit or a polycrystalline diamond compact (PDC) bit.

10. A system for improving a drilling speed by using drill string vibration, the system comprising: a power source that generates power by bit pressure fluctuation in a bit body; wherein the system is configured such that drilling fluid enters into a lumen in a downhole drill string vibration-reduction and supercharging device after being shunt by a shunt mechanism, most part of the drilling fluid is injected via an ordinary pressure nozzle; other small part of the drilling fluid enters into a power conversion unit via an inlet one-way valve in the downhole drill string vibration-reduction and supercharging device; after obtaining the power source and high energy coming from reducing a fluctuation amplitude of bit pressure, the small part of the drilling fluid is discharged via an outlet one-way valve connecting a high-pressure runner and is finally injected by a ultra-high pressure drilling fluid nozzle to realize an ultra-high pressure jet which facilitates rock cracking directly or auxiliarily; the power conversion unit is composed by a sealing assembly, a supercharging cylinder and a supercharging cylinder righting sleeve.

11. The system of claim 10 characterized in that, the power conversion unit comprises: a power conversion cavity, a transmission lever of bit pressure, springs, a drill string body and a lubricant cavity; the power conversion cavity is composed by the sealing assembly, the supercharging cylinder and the supercharging cylinder righting sleeve; the transmission lever of bit pressure is composed of an upper transition joint, an upper plugging joint of the spring, a central shaft, a piston shaft, a locking nut and the inlet one-way valve; the lubricant cavity is composed by the upper plugging joint of the spring, a spring outer case, the lower plugging joint of the spring and the central shaft; increasing of the inject pressure of drilling fluid is completed in a lumen body of power conversion; wherein an increase of bit pressure on the bit body causes the transmission lever of bit pressure to compress the drilling fluid and the spring in the lumen body of power conversion; the pressure increase of the drilling fluid in the lumen body of power conversion enables closing of the inlet one way valve and opening of the outlet one way valve; the drilling fluid obtaining energy from the power source is discharged via the outlet one way valve and ejected via ultra-high drilling fluid nozzle to realize ultra-high pressure efflux facilitating rock breaking directly or auxiliarily.

12. The system of claim 11 characterized in that, the spring withstands the pressure of transmission lever of bit pressure and generates compression and stores energy, meanwhile the lubricant on the spring is compressed into the lubricant cavity; as the bit pressure on the drill string body reduces, a flexible element withstanding the pressure of the transmission lever of bit pressure and generating elastic potential energy, stretches and releases energy to decrease the pressure in the power conversion cavity; open the inlet one-way valve of the power conversion unit and close the outlet one-way valve of the power conversion unit; drilling fluid flows into the power conversion cavity, meanwhile the lubricants in the lubricant cavity flows back to the flexible element to lubricate and cool the flexible element.

13. The system of claim 10 characterized in that, two flows of the drilling fluid shunt by the shunting structure flow into a shaft bottom along two separate runners respectively without interfering with each other; as the power conversion unit is disabled, the drilling fluid can enter into the ordinary pressure nozzle via the shunt mechanism and be injected out by the ordinary pressure nozzle.

* * * * *